US011047553B2

(12) United States Patent
Gomez Martinez et al.

(10) Patent No.: US 11,047,553 B2
(45) Date of Patent: Jun. 29, 2021

(54) LOW PROFILE LARGE AREA LUMINAIRE

(71) Applicant: NICOR, INC., Albuquerque, NM (US)

(72) Inventors: Jorge Alfredo Gomez Martinez, Albuquerque, NM (US); David Brown, Rio Rancho, NM (US); Ye Jin, Albuquerque, NM (US); Jiabin Yu, Zhongshan (CN); Zihai Lu, Zhongshan (CN); Trevor Shaw, Albuquerque, NM (US)

(73) Assignee: NICOR, INC., Albuquerque, NM (US)

( * ) Notice: Subject to any disclaimer, the term of this patent is extended or adjusted under 35 U.S.C. 154(b) by 49 days.

(21) Appl. No.: 16/405,866

(22) Filed: May 7, 2019

(65) Prior Publication Data

US 2019/0323687 A1 Oct. 24, 2019

Related U.S. Application Data

(63) Continuation-in-part of application No. 16/169,856, filed on Oct. 24, 2018, now Pat. No. 10,824,427.

(60) Provisional application No. 62/576,877, filed on Oct. 25, 2017, provisional application No. 62/668,642, filed on May 8, 2018, provisional application No. 62/764,678, filed on Aug. 15, 2018, provisional application No. 62/668,667, filed on May 8, 2018.

(51) Int. Cl.

| | |
|---|---|
| ***F21S 8/04*** | (2006.01) |
| ***F21V 15/01*** | (2006.01) |
| ***F21V 15/015*** | (2006.01) |
| ***F21V 5/04*** | (2006.01) |
| ***F21V 23/04*** | (2006.01) |
| ***F21V 7/00*** | (2006.01) |
| *F21Y 103/10* | (2016.01) |
| *F21Y 115/10* | (2016.01) |

(52) U.S. Cl.

CPC ..... *F21V 15/013* (2013.01); *F21V 5/04* (2013.01); *F21V 7/00* (2013.01); *F21V 15/015* (2013.01); *F21V 23/0471* (2013.01); *F21Y 2103/10* (2016.08); *F21Y 2115/10* (2016.08)

(58) Field of Classification Search

CPC ..... F21Y 2103/10; G02B 6/0073

See application file for complete search history.

(56) References Cited

U.S. PATENT DOCUMENTS 7,311,423 B2 12/2007 Frecska
7,476,004 B2 1/2009 Chan (Continued)

*Primary Examiner* — Andrew J Coughlin

(74) *Attorney, Agent, or Firm* — Loza & Loza LLP; Richard H. Krukar

(57) ABSTRACT

A luminaire a small number of carefully designed extrusions is easily manufactured. The housing is formed by joining four pieces having a first extrusion profile. A second extrusion profile is used for the side and end covers. A third profile is used for access covers. The housing frames a lens, such as an acrylic sheet, and long lines of LEDs are positioned to shine directly into the side of the lens. A reflective layer on the lens directs all or some of the LED light out the luminaire's front, perhaps directing some light out the back. Strategically positioned diffusors ensure a pleasing lighting effect. The result is a very thin and light weight luminaire having a large surface area. The luminaire can be suspended by threaded nipples, by cables threaded through holes in the back, or by brackets screwed to threaded inserts.

18 Claims, 20 Drawing Sheets

(56) References Cited

U.S. PATENT DOCUMENTS

| | | | | |
|---|---|---|---|---|
| 8,696,154 | B2 * | 4/2014 | Hutchens | F21V 7/0016 362/217.05 |
| 9,039,251 | B2 * | 5/2015 | Howe | F21V 17/101 362/329 |
| 9,188,290 | B2 * | 11/2015 | Lay | F21V 23/009 |
| 2007/0047229 | A1 | 3/2007 | Lee | |
| 2007/0058377 | A1 | 3/2007 | Zampini | |
| 2008/0112183 | A1 * | 5/2008 | Negley | F21K 9/61 362/555 |
| 2011/0149596 | A1 * | 6/2011 | Lv | G02B 6/0073 362/607 |
| 2012/0113628 | A1 | 5/2012 | Burrow | |
| 2012/0162982 | A1 | 6/2012 | Wang | |
| 2012/0250309 | A1 | 10/2012 | Handsaker | |
| 2012/0320627 | A1 | 12/2012 | Araki | |
| 2013/0094225 | A1 | 4/2013 | Leichner | |
| 2015/0016100 | A1 | 1/2015 | Ishii | |
| 2016/0076743 | A1 | 3/2016 | Deutsch | |

* cited by examiner

LOW PROFILE LARGE AREA LUMINAIRE

CROSS REFERENCE TO RELATED APPLICATIONS

This patent application is a continuation in part of U.S. patent application Ser. No. 16/169,856 and claims the priority and benefit of U.S. Provisional Patent Applications 62/576,877, 62/668,642, 62/764,678, and 62/668,667. U.S. patent application Ser. No. 16/169,856 is titled "METHOD AND SYSTEM FOR POWER SUPPLY CONTROL" and was filed Oct. 24, 2018. U.S. Provisional Patent Application 62/576,877 is titled "LUMINAIRE POWER BANK" and was filed Oct. 25, 2017. U.S. Provisional Patent Application 62/668,642 is titled "METHOD AND SYSTEM FOR POWER SUPPLY CONTROL" and was filed May 8, 2018. U.S. Provisional Patent Application 62/764,678 is titled "METHOD AND SYSTEM FOR POWER SUPPLY CONTROL" and was filed Aug. 15, 2018. U.S. Provisional Application 62/668,667 is titled, "Low Profile Large Area Luminaire" and was filed on May 8, 2018. U.S. patent application Ser. No. 16/169,856 and U.S. Provisional Patent Applications 62/576,877, 62/668,642, 62/764,678, and 62/668,667 are herein incorporated by reference in their entirety.

TECHNICAL FIELD

Embodiments are generally related to LED lighting, lighting fixtures, and LED lighting power supplies.

BACKGROUND

Lighting systems have been evolving at a rapid pace with moves from incandescent, fluorescent, and gas discharge to light emitting diodes (LEDs). LEDs have been improving in efficiency, thermal management, and cost. Similarly, the power supplies, a.k.a. drivers, which drive the LEDs have seen improvements in efficiency, thermal management and cost. In general, residential and commercial lighting is transitioning to the use of LED lighting technologies.

U.S. Pat. No. 7,311,423 by Frecska et al. issued on Dec. 25, 2007 and is titled "Adjustable LED Luminaire." Frecska teaches a luminaire having multiple movable LED strips in a large fixture. It is for its teachings of LED arrays, electronics, drivers, and fixtures that U.S. Pat. No. 7,311,423 is herein incorporated by reference in its entirety.

U.S. Pat. No. 7,476,004 by Chan issued on Jan. 13, 2009 and is titled "LED Lighting Lamp Tube." Chan teaches LED arrays mounted in tubes and configured to replace fluorescent light tubes in fluorescent fixtures. Replacements such as Chan's have provided an early upgrade path for commercial lighting in the move from fluorescent to LED. It is for its teachings of LED arrays, electronics, drivers, and fixtures that U.S. Pat. No. 7,476,004 is herein incorporated by reference in its entirety.

U.S. patent application Ser. No. 13/383,917 by Burrow et al. published as US 20120113628 on May 10, 2012 and is titled "Light Emitting Diode Retrofit Conversion Kit for a Fluorescent Light Fixture." Burrow also teaches LED arrays configured to replace fluorescent light tubes in fluorescent fixtures. Replacements such as Burrow's have provided an early upgrade path for commercial lighting in the move from fluorescent to LED. It is for its teaching s of LED arrays, electronics, drivers, and fixtures that US 20120113628 is herein incorporated by reference in its entirety.

U.S. patent application Ser. No. 13/075,494 by Handsaker published as US 20120250309 on Oct. 4, 2012 and is titled "LED Lighting Fixture With Reconfigurable Light Distribution Pattern." Handsaker teaches modular LED arrays with reconfigurable lenses and a fixture with an extruded aluminum base. It is for its teachings of LED arrays, electronics, drivers, and fixtures that US 20120250309 is herein incorporated by reference in its entirety.

U.S. patent application Ser. No. 13/473,929 by Araki, et al. published as US 20120320627 on Dec. 20, 2012 and is titled "Flat Panel Lighting Device and Driving Circuitry." Araki teaches modular LED arrays and drivers configured in a relatively thin flat frame that can be edge lit. It is for its teachings of LED arrays, electronics, drivers, and fixtures that US 20120320627 is herein incorporated by reference in its entirety.

U.S. patent application Ser. No. 14/210,991 by Ishii published as US 20150016100 on Jan. 15, 2015 and is titled "Luminaire." Ishii teaches a fixture having an LED array and drivers with a long lens covering the electronic components. It is for its teachings of LED arrays, electronics, drivers, and fixtures that US 20150016100 is herein incorporated by reference in its entirety.

As can be inferred by this background section, the prior art discloses luminaires that can be used commercially, but that the overall packaging, fixtures, drivers, interconnects, and designs are still evolving. Systems and methods providing LED lighting with advanced packaging, fixtures, drivers, interconnects, and designs are needed.

BRIEF SUMMARY

The following summary is provided to facilitate an understanding of some of the innovative features unique to the disclosed embodiments and is not intended to be a full description. A full appreciation of the various aspects of the embodiments disclosed herein can be gained by taking the entire specification, claims, drawings, and abstract as a whole.

It is an aspect of the embodiments that a luminaire can have a rectangular housing formed from four permanently joined housing members. The housing members can be permanently and rigidly joined to form the housing. The housing members, all have the same extrusion profile, here called the housing extrusion profile. The housing members include a housing top, a housing bottom, a housing first end, and a housing second end. The housing is rectangular because the housing top and housing bottom are equally long while the housing first end and the housing second end are also equally long. The housing members can be joined by welding with the seams smoothed and treated such that the joints are invisible. The illustrated embodiments have the housing top/bottom approximately six times longer than the housing first/second ends. The housing members have an LED backing, a lens shelf, a top slot, a screw groove, a back opening, and a cover engagement. As such, the housing has a lens shelf a top slot, a screw groove, a back opening, and a cover engagement.

It is another aspect of the embodiments that LED circuit assemblies can be positioned against the LED backing. The LED circuit assemblies have a row of LEDs mounted on a circuit board or similar rigid or flexible backing having circuit traces. The LEDs produce light when properly conditioned electric power is provided to input pads or leads of the LED circuit assemblies. The illustrated embodiments have a top LED circuit assembly and a bottom LED circuit assembly. The top LED circuit assembly is disposed along the LED backing of the housing top. The bottom LED circuit assembly is disposed along the LED backing of the housing bottom.

It is yet another aspect of the embodiments that a lens is positioned inside the housing. The outer edges of the lens can rest against the housing's lens shelf. Recall that the housing lens shelf was formed by joining the housing members, each having a lens shelf, to produce the housing. The lens is a sheet of material such as a transparent or clear acrylic sheet. The edges of the lens are the four thin sides of the sheet while the faces of the lens are the two large sides of the sheet. When powered, the LEDs emit light. The lens is sized and positioned such that the LEDs can shine light into one or more lens edge. A reflective layer on one of the lens faces can direct all or some of the LED light out the other face. A portion of the LED light can pass through the reflective layer if it is partially reflecting or has clear openings. Various embodiments can have a transparent, translucent, or frosted lens depending on the desired lighting properties.

It is still another aspect of the embodiments that a plurality of side covers can cover much of the top openings of the housing top and housing bottom while also holding the lens within the housing. All of the side covers have the same extrusion profile, the side cover extrusion profile. The side covers have a top engagement, a bottom engagement, and a lens interface. The side covers are installed in the housing when the top engagements fit into the top slot, the bottom engagements fit under the cover engagement, and the lens interfaces prevent the lens from exiting the housing.

With the housing assembled, LEDs positioned, lens installed, and side covers installed it is easy to discern the front, back, bottom, top, first end, and second end. The back of the luminaire is the large flat side having the side covers and the back of the lens. The front side is opposite the back side. The first and second ends are the short sides of the housing rectangle. The top and bottom are the long sides of the housing rectangle. The first end and the second end are separated by the length or the luminaire. The top and the bottom are separated by the height of the luminaire. The front and the back are separated by the thickness of the luminaire. In most embodiments, all the LED light or a majority of the LED light exits the front of the luminair. Light that does not exit the front of the luminaire can exit the back of the luminaire.

It is a further aspect of the embodiments that the luminaire can have four access covers with one at each corner. The access covers all have the same profile, called the access cover profile. The access covers can be extruded aluminum or can be stamped from a sheet such as sheet steel. The illustrated embodiments show access covers with extrusion profiles different from those of the side covers. For example, the access covers are thinner than the side covers. Each access cover has a slot engagement and at least one housing screw hole. The slot engagements fit into the housing and can engage the housing's top slot on both sides of the corner. For example, the access cover positioned at the corner defined by the housing top and the housing first end can have its slot engagement in the top slots of both the housing top and the housing first end. The access covers are held in position by housing screws passing through the housing screw holes and threaded into the screw groove of a housing member. An access cover can be permanently attached to a side cover, thereby holding the side cover in position. For example, an assembly can have a side cover with an access cover attached at each end such that the assembly is held in position by the top slot and cover engagement of the housing and by housing screws. The illustrated embodiments show a similar assembly with two side covers attached together and access covers attached at the far ends of the two side covers.

It is still yet another aspect of the embodiments that end covers cover the back opening of the housing first end and housing second end. The end covers can all have the same extrusion profile called the end cover extrusion profile. The illustrated embodiments show end covers having the same extrusion profile and the side covers. Each end cover can have a top end engagement, a bottom end engagement, and a lens end interface. When installed in the housing, the top end engagement is positioned in the top slot of either the housing first end or the housing second end and the bottom engagement is positioned under the cover engagement of either the housing first end or the housing second end. The end cover's lens end interface prevents the lens from exiting the housing. The end covers can have housing screw holes such that the end covers can be held in position by housing screws passing through the housing screw holes and threaded into the screw groove of a housing member.

The space within the housing and covered by side covers, access covers, or end covers is called the wireway because the luminaire's wiring typically runs through the wireway. In addition, electric components such as a motion sensor, power conditioner, control block, etc. can be positioned within the wireway. A motion sensor can detect motion near the luminaire and cause the LEDs to turn on. Some embodiments have a control block communicating with the motion sensor. The motion sensor detects motion, signals the control block, and the control block turns on the LEDs. The motion sensor can observe the environment through sensor lens mounted in a hole in the housing. A power conditioner can condition externally supplied electric power, such as 120 VAC mains power, for use by the LEDs and other electric components. Embodiments having an internal power conditioner can be powered by unconditioned external power, such as mains power, while embodiments having no internal power conditioner must be powered by external power that is already conditioned for use by the LEDs.

The external electric power can be passed from an external source, through an access cover, and into the interior of the luminaire. An access cover can have a knockout that can be pushed free of the access cover to produce a hole, called an access opening, in the access cover. Wires can pass through the access opening in the access cover and into the wireway. Alternatively, an access cover can have an electrical connector for passing electric power or signals into the luminaire. An electric cable, such as an IMS cable, a shielded cable or an Ethernet cable can provide electric power and/or signals to the electrical connector, thereby powering and/or controlling the luminair. For example, a plug on an electric supply cable can be plugged into a socket attached to the access cover to thereby power the luminaire. The electric socket can be configured to engage the plug to thereby pass electric power through the electric socket and into the luminaire.

The electrical connector can be a panel feedthrough terminal block. For example, electric power can be provided to the luminaire by an electric cable having at least two distinct conductors. Here, distinct conductor means insulated from one another such as an insulated wire and a bare wire or two insulated wires. In practice, the electric cable would have a power line, a return line, and possibly a ground line. The power line and return line are typically insulated wires while the ground line can be either a bare wire or an insulated wire. An 18/2 shielded cable is an example of an electric cable. The terminal block can be attached to an access cover and can be configured to pass electric power from external wiring and into the internal wiring and circuitry of the luminaire. An 18/2 shielded cable is a shielded cable with two 18 gauge insulated wires and an internal shield covered by an outside insulator. The cable's shield, or a third wire in an alternative embodiment, can provide a ground connection. Electricians and those knowledgeable of electric wiring or the installation of electrical components are familiar with shielded cables and terminal blocks such as panel feed through terminal blocks.

Using an RJ45 socket as the electric socket provides for using Ethernet cables to supply the luminaire with electric power or signals. Power Over Ethernet (POE) is a known set of standards for supplying power and signals to computer network equipment via Ethernet cables. An RJ45 socket has a row of eight contacts. A luminaire can be powered via POE or can be powered by simply running power with no signals into two or more of those contacts. For example, the electric power line or lines can be directly electrically connected to four of the RJ45 socket contacts while the return line or lines can be directly electrically connected to the other four RJ45 socket contacts. In such embodiments, an RJ45 power circuit that includes the RJ45 socket can be fixedly attached to the access cover while a hole in the access cover provides access to the RJ45 socket. Embodiments can pass power through an endcap by, for example, fixedly attaching the RJ45 power circuit to an endcap while a hole in the endcap provides access to the RJ45 socket.

Using an IMS chassis connector as the electric socket provides for using IMS cables to supply the luminaire with power and control signals. When using an IMS chassis connector, electric power can pass via two conductors and control signals can pass via two different conductors. As such, the IMS cable has at least four wires that can be electrically connected to four contacts in the IMS chassis connector. The IMS chassis connector thereby provides for passing electric power via two wires and passing control signals via two different wires into and out of the luminaire. The IMS chassis connector can be installed on an access cover.

It is a further aspect of the embodiments that a lens cover can be positioned in back of the lens. The lens cover blocks light from exiting the back. The lens cover can be a sheet of opaque, translucent, frosted, or textured material. The faces of the lens cover can be the same size as those of the lens such that the lens cover is between the lens and the lens interfaces of the side covers and the lens end interfaces of the end covers. A translucent, frosted, or textured lens cover is called a diffusing lens. LED light exiting the back of the lens can be diffused by the diffusing lens. An opaque lens cover can have a reflective face that reflects light back into the lens, in which case the lens need not have a reflective layer. Regarding the diffusing lens, a luminaire can have a diffusing lens completely covering one side of the lens and preventing the lens from directly contacting the lens interface of the side covers such that the diffusing lens diffuses light exiting the back.

The housing members can be formed from extrusions. Extrusion is a process of shaping material by forcing it to flow through a shaped opening in a die. The extruded material, often called an extrusion, emerges as an elongated piece having a profile that is substantially identical to the profile of the die opening. The profile has profile width and profile height dimensions but not a length dimension. An extrusion can have an extrusion length, extrusion width and extrusion height. Some extrusion processes can form an extrusion with an enclosed void, such as a tube, thereby producing a lighter and stronger extrusion. The die opening profile has features for forming the extrusion's length running elements. As such, the length running elements, such as the enclosed void, are parallel to one another and run the complete length of the extrusion. One advantage of the embodiments discussed herein is that extrusion processes can yield complex, functional, and attractive forms that would otherwise require costly machining. It is a great advantage to form the housing, side covers, end covers, and access covers from extrusions. The housing members can have enclosed voids. A closed channel is formed when housing members having enclosed voids are joined to produce the housing. The illustrated embodiments show housing members with 45 degree cuts and joined to form the 90 degree corners of the housing.

The structural properties of the extrusions, placement of the LEDs, and location of the lens yield a luminaire that produces a large amount of light over a large surface while having an extremely low profile such as the illustrated embodiments having a thickness less than 1.4 inches. The height of the illustrated embodiments is greater than 5.8 times the thickness and less than 6 times the thickness. The length of illustrated embodiments is approximately 6 times the height although other versions have a length approximately 12 times the height.

The luminaire can be produced using extruded aluminum. Aluminum is a good material for luminaires because it is thermally conductive and can help remove heat from the LED circuit assemblies. A thermal compound between the LED circuit assemblies and the housing members can facilitate the transfer of heat from the LEDs into the housing.

It is yet another aspect of the embodiments that the luminaire can have fixture brackets from which the luminaire can be suspended. The luminaire can be held aloft by the fixture brackets. For example, the luminaire can hang from suspension cables attached to the center area of the fixture brackets. Holes in the center area of the fixture brackets can accommodate threaded nipples and lock nuts or other means can keep the threaded nipples securely positioned within the holes and thereby attached to the fixture brackets. The luminaire can be suspended by the threaded nipples. For example, the aforementioned suspension cables can be attached to the threaded nipples and be thereby attached to the fixture brackets.

BRIEF DESCRIPTION OF THE DRAWINGS

The accompanying figures, in which like reference numerals refer to identical or functionally-similar elements throughout the separate views and which are incorporated in and form a part of the specification, further illustrate the present invention and, together with the detailed description of the invention, serve to explain the principles of the present invention.

DETAILED DESCRIPTION

Figure 1:
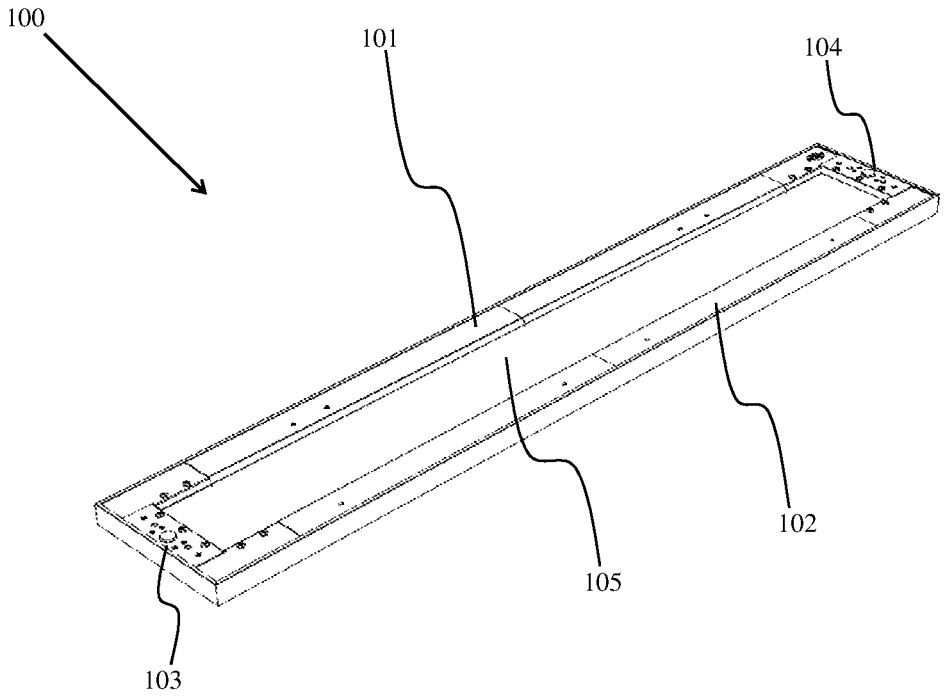
FIG. 1 illustrates a low profile luminaire as viewed from the back in accordance with aspects of the embodiments.

The particular values and configurations discussed in these non-limiting examples can be varied and are cited merely to illustrate at least one embodiment and are not intended to limit the scope thereof.

For a general understanding of the present disclosure, reference is made to the drawings. In the drawings, like reference numerals have been used throughout to designate identical elements.

A luminaire for architectural, industrial and warehouse applications can be manufactured using a small number of carefully designed extrusions. The housing can be formed by permanently joining four pieces having a first extrusion profile. A second extrusion profile can be used for the side and end covers. A third profile can be used for access covers. A lens, such as an acrylic sheet, can be framed by the housing and long lines of LEDs can be positioned to shine directly into the side of the lens. A reflective layer on the lens can direct all or a portion of the LED light out the front of the luminaire. A reflective layer can all or a portion of the LED light out the back. Strategically positioned diffusors can ensure that the lighting effect is pleasing. The result is a very thin and light weight luminaire having a large surface area. The luminaire is easy to deploy because of its light weight. It can be suspended by internal fixture brackets, by cables threaded through holes in the back, or can be screwed to a ceiling or wall using threaded inserts.

Figure 2:
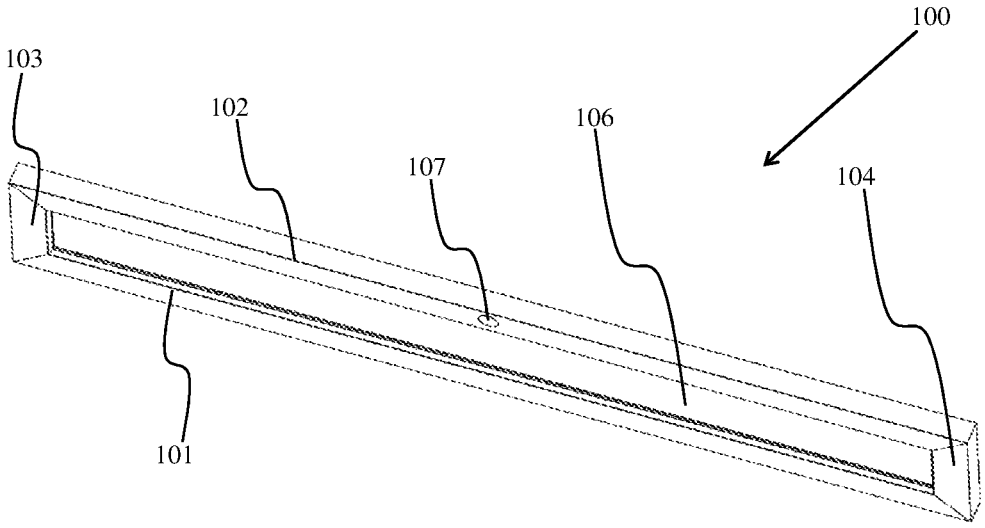
FIG. 2 illustrates a low profile luminaire as viewed from the front in accordance with aspects of the embodiments.

FIGS. 1 and 2 illustrate a low profile luminaire 100 as viewed from the back and front, respectively, in accordance with aspects of the embodiments. The luminaire 100 has a top 101, a bottom 102, a first end 103, a second end 104, a back 105, and a front 106. A sensor lens 107 can be seen in the front view.

Figure 3:
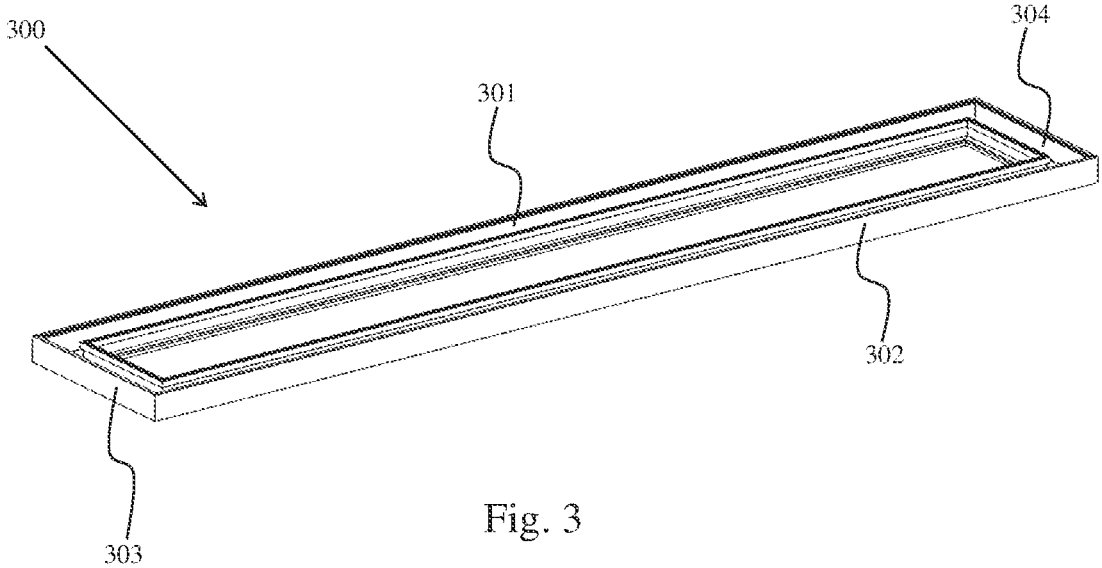
FIG. 3 illustrates a housing as viewed from the back in accordance with aspects of the embodiments.
Figure 4:
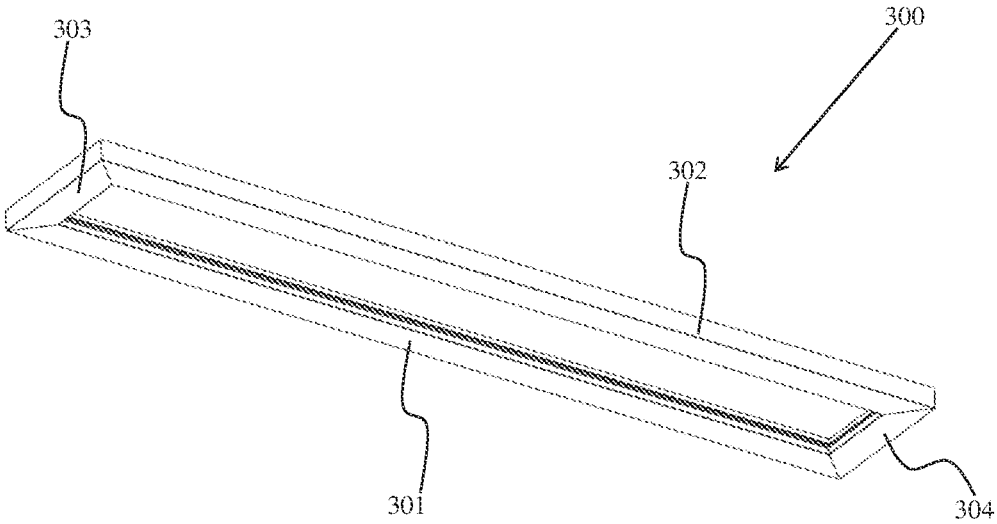
FIG. 4 illustrates a housing as viewed from the front in accordance with aspects of the embodiments.

FIGS. 3 and 4 illustrate a housing 300 as viewed from the back and front, respectively, in accordance with aspects of the embodiments. The housing 300 has can be made by permanently attaching, perhaps by welding, four housing members. The housing members are a housing top 301, a housing bottom 302, a housing first end 303, and a housing second end 304. The housing 300 is rectangular with the housing top 301 being the same length as the housing bottom 302 while the housing first end 303 has the same length as the housing second end 304.

Figure 5:
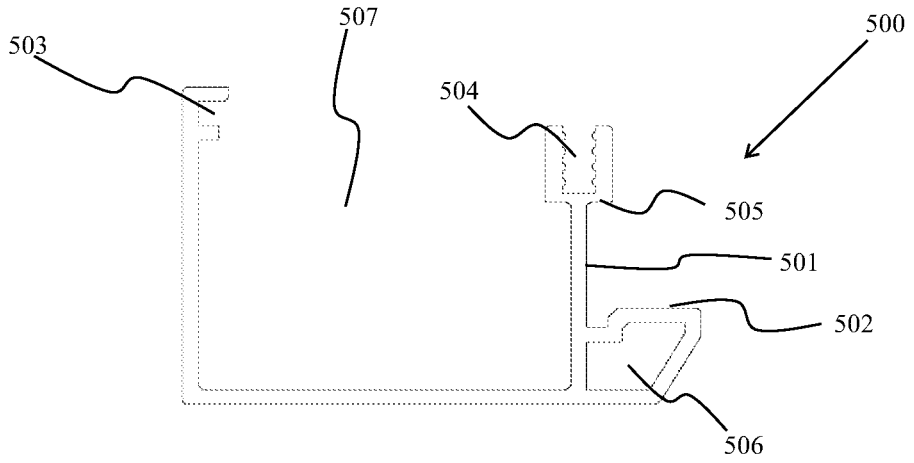
FIG. 5 illustrates a housing extrusion profile in accordance with aspects of the embodiments.

FIG. 5 illustrates a housing extrusion profile 500 in accordance with aspects of the embodiments. The housing members 301, 302, 303, 304 can be formed from extrusions having housing extrusion profile 500. Housing extrusion profile 500 shows the LED backing 501, lens shelf 502, top slot 503, screw groove 504, cover engagement 505, back opening 507, and enclosed void 506 of each of the housing members.

Figure 6:
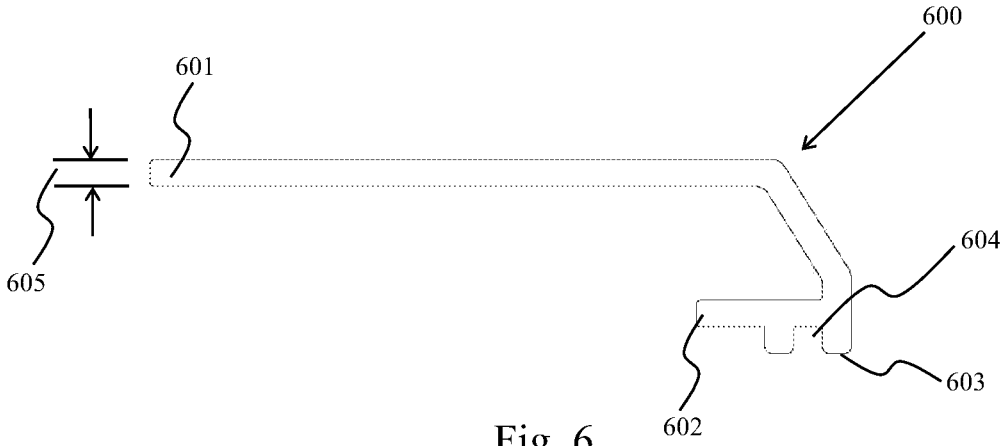
FIG. 6 illustrates a side cover extrusion profile in accordance with aspects of the embodiments.

FIG. 6 illustrates a side cover extrusion profile 600 in accordance with aspects of the embodiments. The side covers can be formed from extrusions having side cover extrusion profile 600. Side cover extrusion profile 600 shows the top engagement 601, bottom engagement 602, and lens interface 603 of the side covers. Note that the illustrated lens interface 603 has a lens interface groove 604, which is an aspect of some embodiments. The side covers have a side cover thickness 605.

Figure 7:
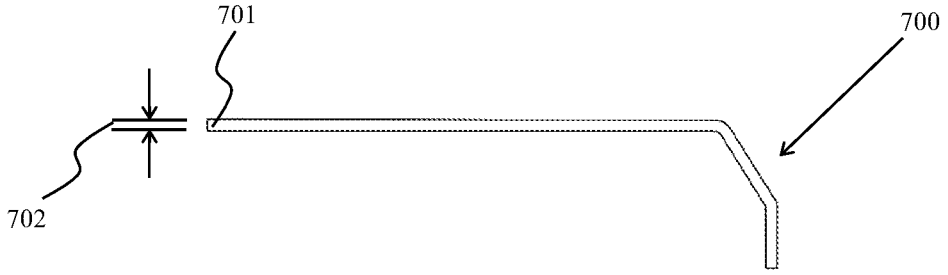
FIG. 7 illustrates an access cover profile in accordance with aspects of the embodiments.

FIG. 7 illustrates an access cover profile 700 in accordance with aspects of the embodiments. The access covers can be stamped or formed from extrusions having access cover profile 700. Access cover profile 700 shows the slot engagement 701 and has access cover thickness 702. The illustrated embodiments have an access cover thickness 702 that is less then side cover thickness 605.

Figure 8:
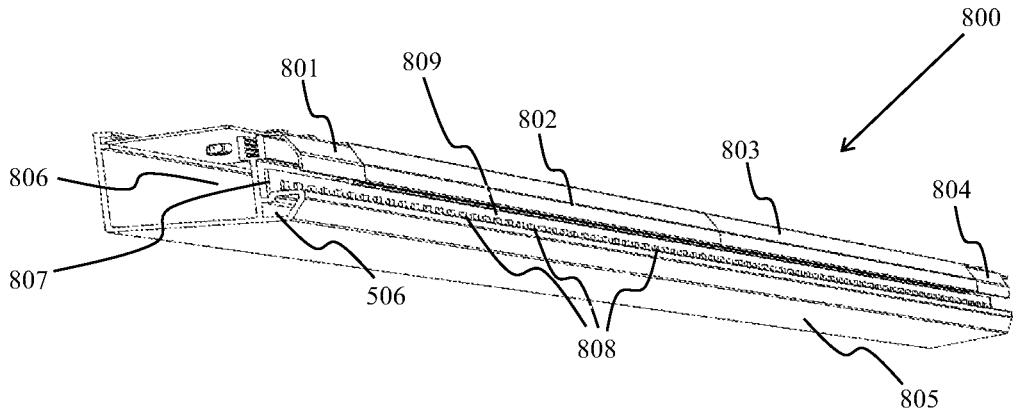
FIG. 8 illustrates a top assembly in accordance with aspects of the embodiments.
Figure 9:
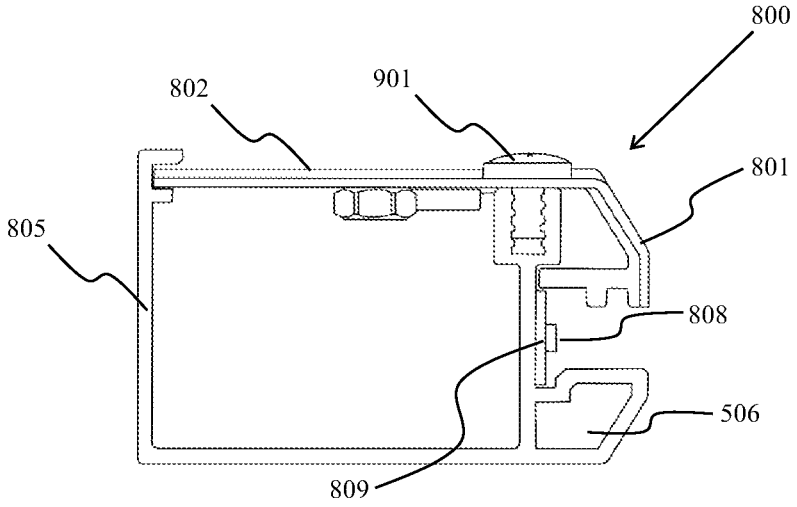
FIG. 9 illustrates an end view of the top assembly of FIG. 8 in accordance with aspects of the embodiments.

FIGS. 8 and 9 illustrate a long side assembly 800 in accordance with aspects of the embodiments. Long side assemblies 800 form the top 101 and bottom 102 of the luminaire 100. Access covers 801, 804 and side covers 802, 803 are installed on housing member 805. The access cover slot engagements 701 and the side cover top engagements 601 are in the top slot 503 of the housing member 805. A LED circuit assembly 807 is positioned against the housing member's LED backing 501. The LED circuit assembly 807 has a large number of LEDs 808 arranged on a circuit board 809. The wireway 806 is covered by the side covers 802, 803 and access covers 801, 804. Housing screw 901 fixes access cover 801 in position. Access covers 801, 804 and side covers 802, 803 can be permanently attached end to end as shown if FIGS. 8 and 11 to form a unit that is fixed in position to the housing by housing screws. The long side assembly 800 is presented for clarification purposes. It is anticipated that the housing will be fully assembled before being populated with side covers, access covers, end covers, etc.

Figure 10:
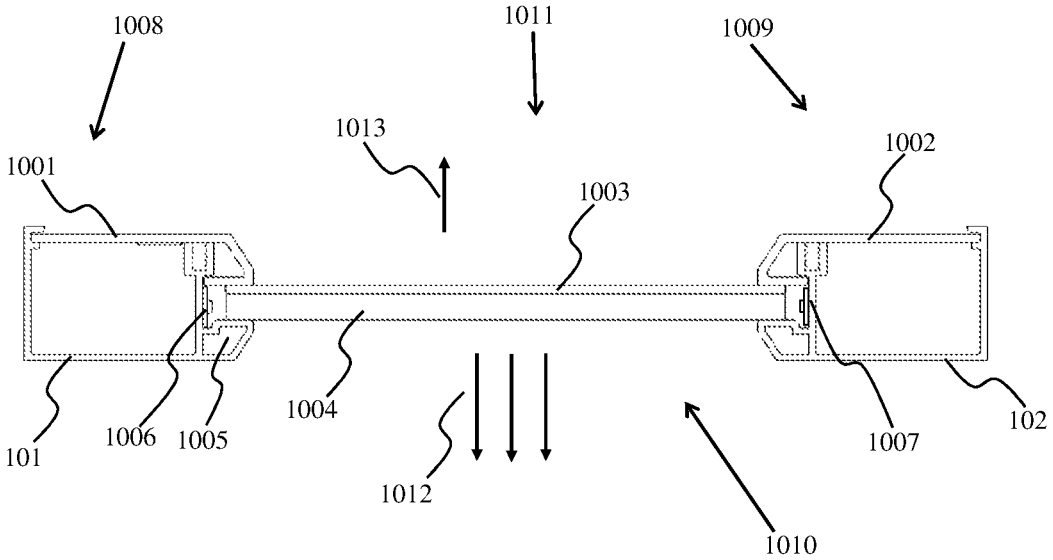
FIG. 10 illustrates a lens and lens cover properly positioned in a top assembly and bottom assembly in accordance with aspects of the embodiments.

FIG. 10 illustrates a lens 1004 and lens cover 1003 properly positioned in a top assembly 1008 and bottom assembly 1009 in accordance with aspects of the embodiments. The top assembly 1008 and the bottom assembly 1009 are long side assemblies 800. Being a cut view, FIG. 10 shows the interior areas of the luminaire such as closed channel 1005. Top side cover 1001 is installed on housing top 301. Bottom side cover 1002 is installed on housing bottom 302. Top LED circuit assembly 1006 and bottom LED circuit assembly 1007 are positioned to shine light directly into the edges of the lens 1004. A portion of the LED light 1012 exits the front 1010 of the luminaire and another portion of the LED light 1013 exits the back 1011 of the luminaire.

Figure 11:
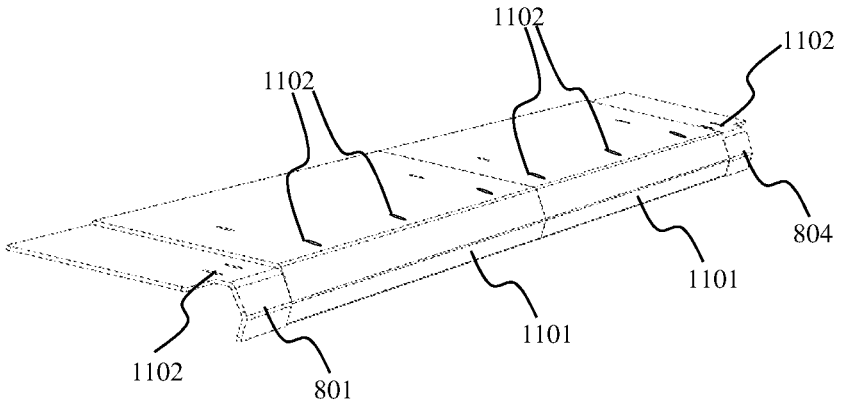
FIG. 11 illustrates two side covers and two access covers viewed from above in accordance with aspects of the embodiments.
Figure 12:
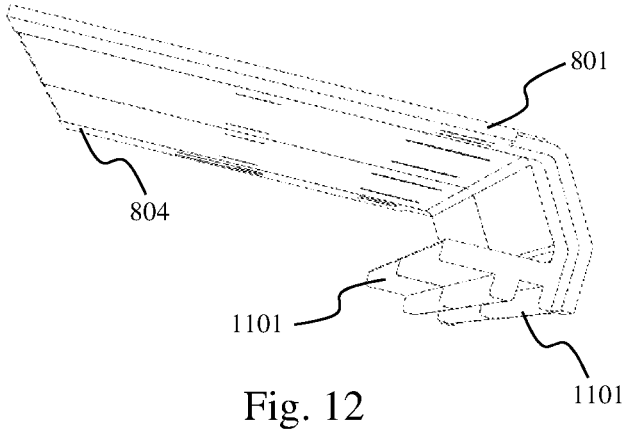
FIG. 12 illustrates two side covers and two access covers viewed from below in accordance with aspects of the embodiments.

FIGS. 11 and 12 illustrate two side covers 1101 and two access covers 801, 804 viewed from above and below, respectively, in accordance with aspects of the embodiments. As discussed above the two side cover 1101 and access covers 801, 804 can be attached, as shown, to form a single unit. Alternatively, the side covers 1101 can be attached to the housing by passing housing screws through housing screw holes 1102 in the side covers 1101 and threading the housing screws into a screw groove 504 of a housing member. Side covers 1101 can be seen to be bottom side covers for the illustrated embodiments. The access covers 801, 804 are illustrated as each having two housing screw holes 1102.

Figure 13:
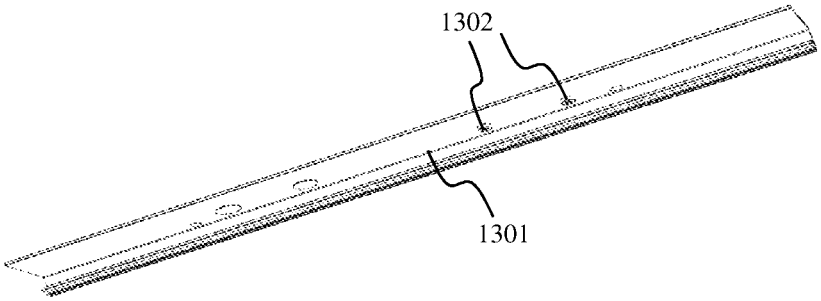
FIG. 13 illustrates a side cover with threaded inserts in accordance with aspects of the embodiments.

FIG. 13 illustrates a side cover 1301 with threaded inserts 1302 in accordance with aspects of the embodiments. Comparing side cover 1301 to luminaire 100, it is seen that side cover 1301 is a top side cover. The threaded inserts 1302 are permanently attached to top side cover 1301 such that mounting screws can be threaded into the threaded inserts 1302 from the back of the luminaire 100. In this manner the luminaire can be wall mounted.

Figure 14:
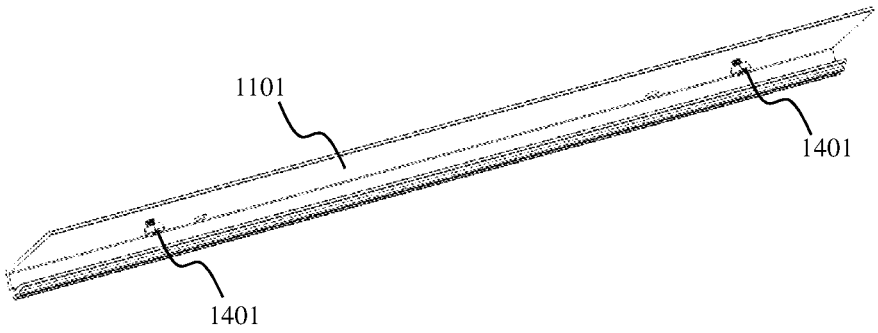
FIG. 14 illustrates a side cover configured to hold a power conditioner in accordance with aspects of the embodiments.

FIG. 14 illustrates a side cover 1101 configured to hold a power conditioner in accordance with aspects of the embodiments. A power conditioner can be attached to bottom side cover 1101 by screws and bolts 1401. Note that the identification of some side covers as "top" and others as "bottom" is not intended to be positionally limiting.

Figure 15:
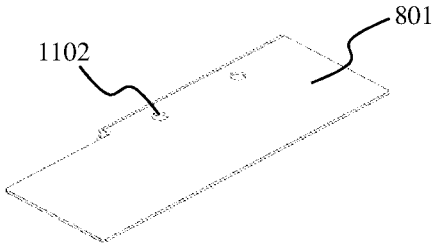
FIG. 15 illustrates an access cover in accordance with aspects of the embodiments.

FIG. 15 illustrates an access cover 801 in accordance with aspects of the embodiments. The access cover 801 is illustrated as each having two housing screw holes 1102.

Figure 16:
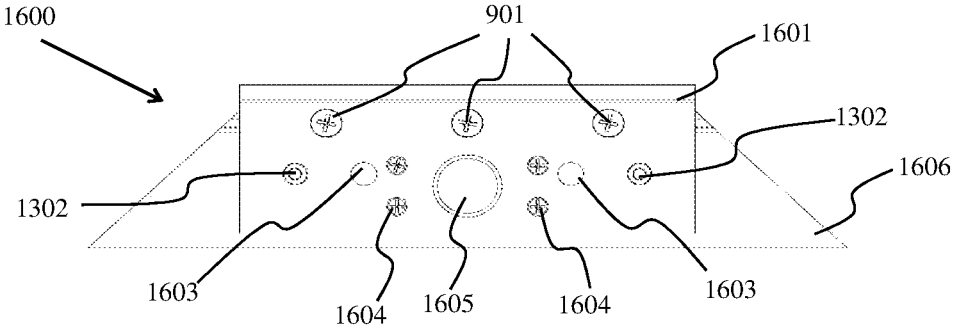
FIG. 16 illustrates an end assembly in accordance with aspects of the embodiments.
Figure 17:
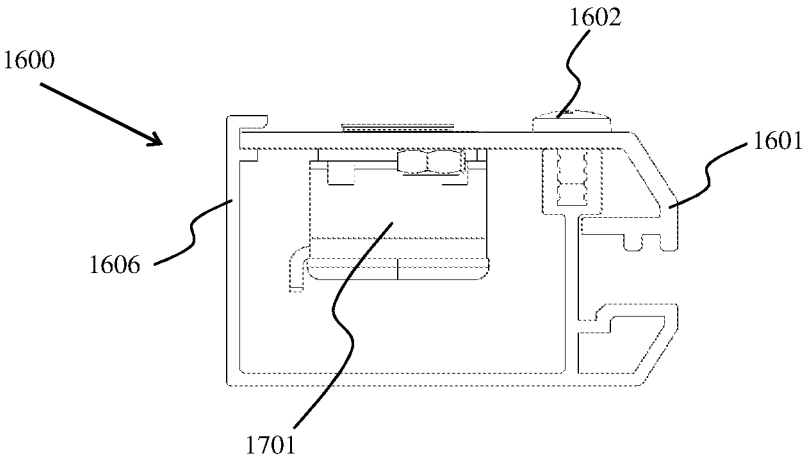
FIG. 17 illustrates an end view of the end assembly of FIG. 16 in accordance with aspects of the embodiments.

FIGS. 16 and 17 illustrate an end assembly 1600 in accordance with aspects of the embodiments. End cover 1601 is positioned with its top end engagement in the top slot of a housing end member 1606 and its bottom end engagement positioned under the cover engagement of the housing end member 1606. Housing end member 1606 can be either the housing first end 303 or the housing second end 304. As discussed above, end covers can have the same profile as the side covers and can therefore engage housing members in the same manner. End cover 1601 is fixed in position by housing screws 901 passing through housing screw holes in the end cover 1601 and threaded into the screw groove 504 of the housing end member 1606. Threaded inserts 1302 attached to the underside of the end cover 1601 are visible. End cover holes 1603 provide for stringing a cable into and out of the end assembly 1600 for use in suspending the luminaire 100. Fixture bracket screws 1604 attach a fixture bracket assembly 1701 to the underside of end cover 1601. A removable plug 1605 plugs a hole directly above the fixture bracket assembly 1701. Removing the removable plug 1605 gives access to the threaded nipple of the fixture bracket assembly 1701.

Figure 18:
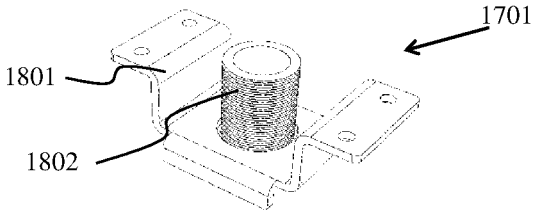
FIG. 18 illustrates a fixture bracket assembly in accordance with aspects of the embodiments.
Figure 19:
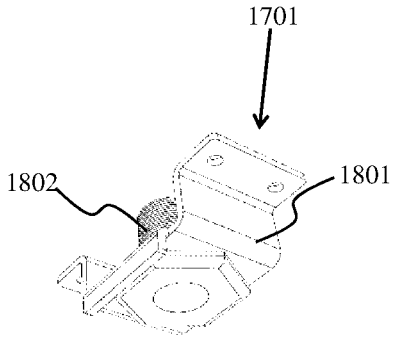
FIG. 19 illustrates a second view of the fixture bracket assembly of FIG. 18 in accordance with aspects of the embodiments.

FIGS. 18 and 19 illustrate a fixture bracket assembly 1701 in accordance with aspects of the embodiments. The fixture bracket assembly 1701 has a fixture bracket 1801 and a threaded nipple 1802. The threaded nipple 1802 provides a convenient attachment from which the luminaire 100 can be suspended.

Figure 20:
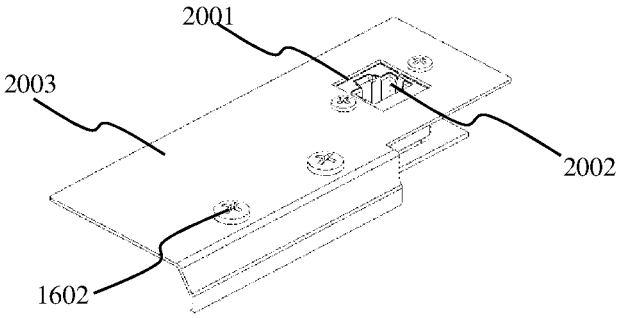
FIG. 20 illustrates an access cover with a connector assembly in accordance with aspects of the embodiments.

FIG. 20 illustrates an access cover 2003 with a connector assembly in accordance with aspects of the embodiments. The illustrated access cover 2003 has a hole 2001 through which a RJ45 socket 2002 can be seen. Here, the connector assembly is a RJ45 connector assembly 2100.

Figure 21:
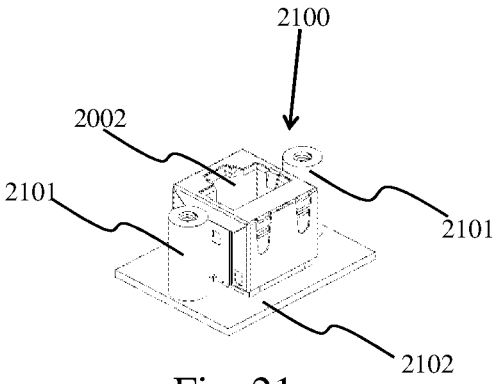
FIG. 21 illustrates a RJ45 connector assembly in accordance with aspects of the embodiments.

FIG. 21 illustrates a RJ45 connector assembly 2100 in accordance with aspects of the embodiments. The RJ45 connector assembly 2100 has a RJ45 socket 2002 and two standoffs 2101 fixed to a circuit board 2102. Electric power and control signaling can be passed from an Ethernet cable which is terminated by an RJ45 plug that is plugged into the RJ45 socket 2002. The electric power and control signals are then available on pads or in through holes on the circuit board.

Figure 22:
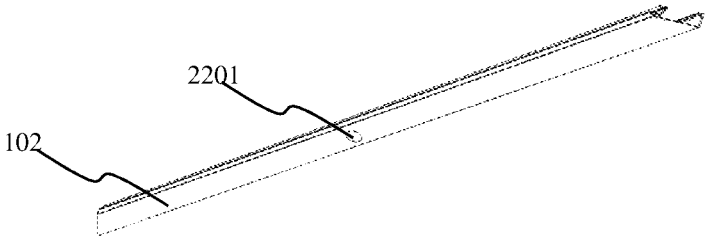
FIG. 22 illustrates a housing member with a sensor opening in accordance with aspects of the embodiments.

FIG. 22 illustrates a housing member 2202 with a sensor opening 2201 in accordance with aspects of the embodiments. The sensor opening 2201 is configured to hold a sensor lens 107.

Figure 23:
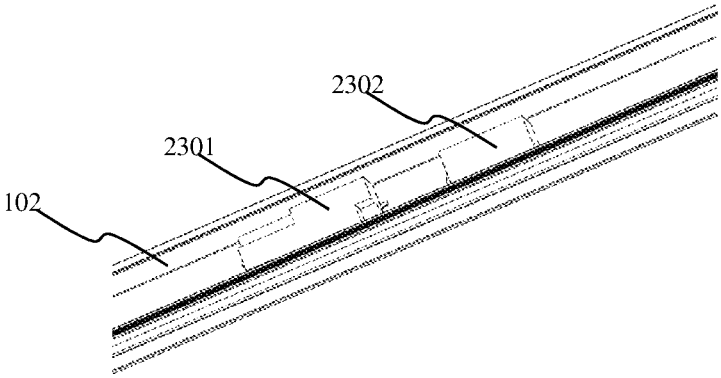
FIG. 23 illustrates a housing member with a motion sensor in accordance with aspects of the embodiments.

FIG. 23 illustrates a housing member 2202 with a motion sensor 2302 in accordance with aspects of the embodiments. The illustrated embodiment has a motion sensor 2302 and a control block 2301. When motion sensor 2302 senses motion it sends a signal to the control block 2301 which turns on the LEDs.

Figure 24:
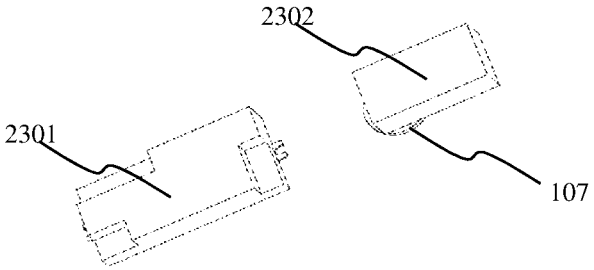
FIG. 24 illustrates a motion sensor in accordance with aspects of the embodiments.
Figure 25:
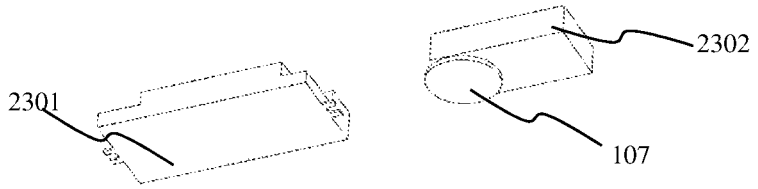
FIG. 25 illustrates another view of the motion sensor of FIG. 24 in accordance with aspects of the embodiments.

FIGS. 24 and 25 illustrate a motion sensor 2301, control block 2301, and sensor lens 107 in accordance with aspects of the embodiments. FIG. 24 is essentially FIG. 23 with a transparent housing member 2202.

Figure 26:
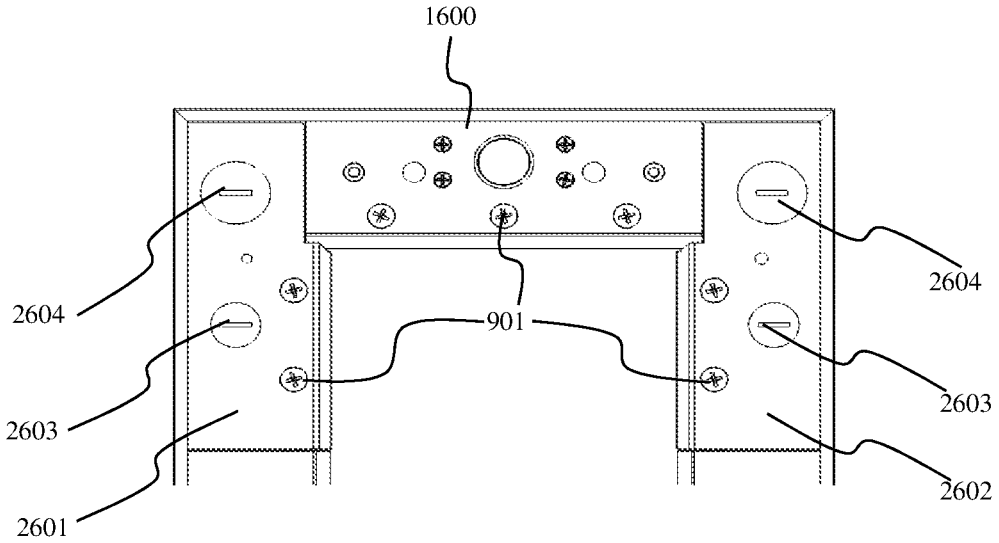
FIG. 26 illustrates access covers with knockouts in accordance with aspects of the embodiments.

FIG. 26 illustrates access covers 2601, 2602 with knockouts 2603, 2604 in accordance with aspects of the embodiments. The access covers 2601, 2602 are shown installed in a luminaire with their slot engagements 701 engaging the top slots 503 of the housing. Each access cover 2601, 2602 engages two housing members because the access covers 2601, 2602 fit into the corners of the housing 300. The access covers 2601, 2602 are fixed in position by housing screws 901. The knockouts 2603, 2604 are configured to be pressed, or knocked, out of the access covers 2601, 2602 and leave a hole through which wires or electric cables can be passed into the wireways under the access covers 2601, 2602. The knockouts 2603, 2604 are of two different sizes such that an installer can choose the size of hole to use.

Figure 27:
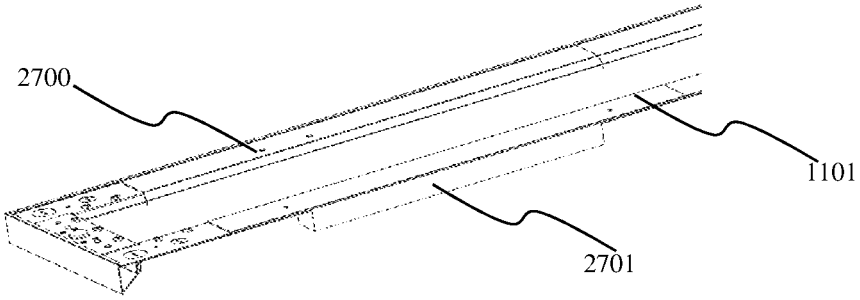
FIG. 27 illustrates a power conditioner in a luminaire in accordance with aspects of the embodiments.
Figure 28:
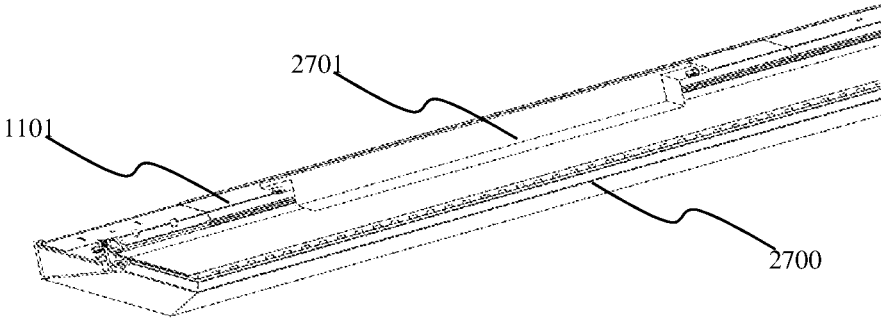
FIG. 28 illustrates a second view of the power conditioner of FIG. 27 in accordance with aspects of the embodiments.

FIGS. 27 and 28 illustrate a power conditioner 2701 in a luminaire 2700 in accordance with aspects of the embodiments. The power conditioner 2701 is attached to side cover 1101. A housing element has been removed to show the power conditioner 2701 as it would be positioned in the wireway.

Figure 29:
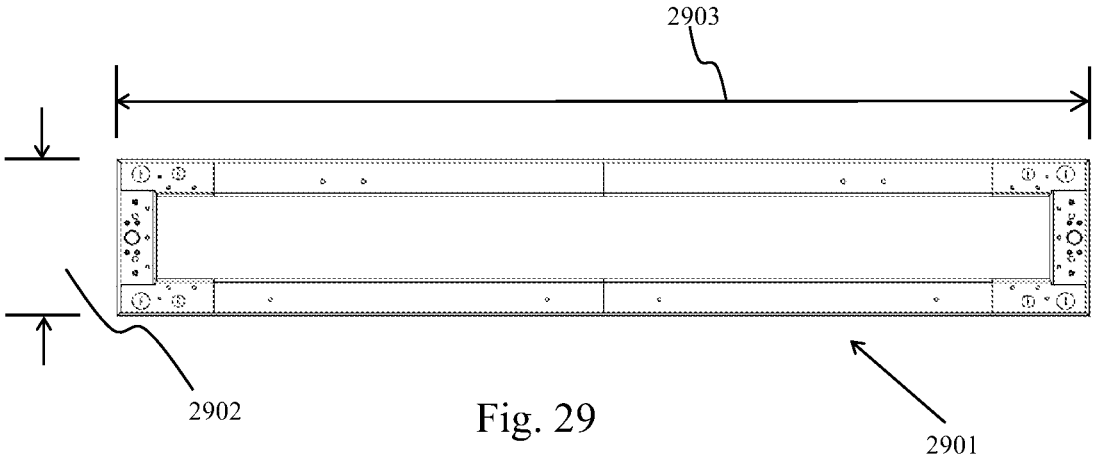
FIG. 29 illustrates a view of the back of a luminaire in accordance with aspects of the embodiments.

FIG. 29 illustrates a view of the back of a luminaire 2901 in accordance with aspects of the embodiments. The luminaire has a length 2903 and a height 2902. As illustrated, the length 2903 is more than 5.5 times the height 2902 and less than 6.5 times the height 2902.

Figure 30:
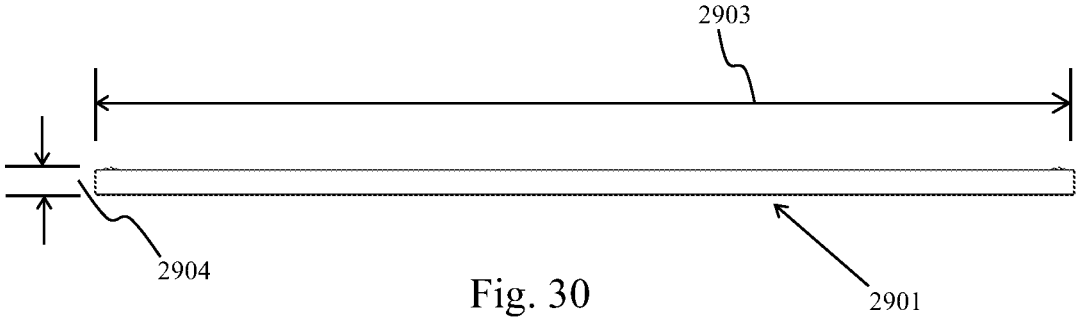
FIG. 30 illustrates a view of the side of a luminaire in accordance with aspects of the embodiments.

FIG. 30 illustrates a view of the side of a luminaire 2901 in accordance with aspects of the embodiments. The luminaire has a thickness 2904 and a length 2903. Embodiments have been assembled with a thickness less than 1.4 inches. Embodiments have been assembled with a thickness greater than 1.2 inches.

Figure 31:
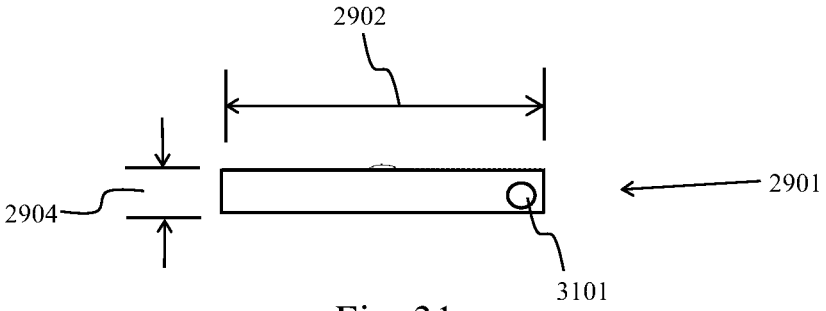
FIG. 31 illustrates a view of the end of a luminaire in accordance with aspects of the embodiments.

FIG. 31 illustrates a view of the end of a luminaire 2901 in accordance with aspects of the embodiments. The luminaire has a thickness 2904 and a height 2902. As illustrated, the height 2902 is more than 5.8 times the thickness 2904 and less than 6 times the thickness 2904. A continuous run hole 3101 in the end of the luminaire provides wireway access through the end of the luminaire 2901 for use in continuous run deployments. The hole can be covered by a knock out or cover when not needed. Wires can pass through the hole to provide power and signals to an adjacent luminaire.

Figure 32:
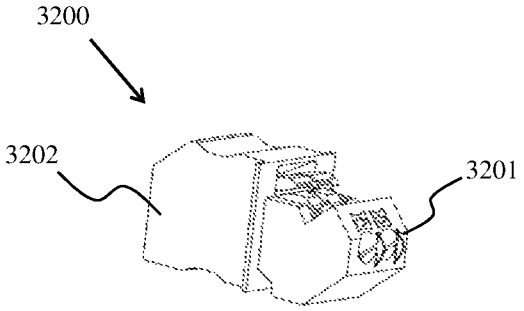
FIG. 32 illustrates a view of a panel feedthrough terminal blocks in accordance with aspects of the embodiments.
Figure 33:
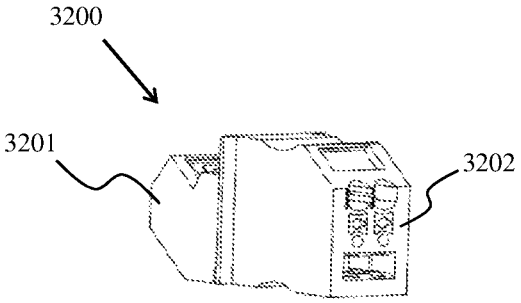
FIG. 33 illustrates a second view of the panel feedthrough terminal block of FIG. 32 in accordance with aspects of the embodiments.

FIGS. 32 and 33 illustrate views of a panel feedthrough terminal block 3200 in accordance with aspects of the embodiments. The panel feedthrough terminal block 3200 has an internal end 3202 and an external end 3201. The panel feedthrough terminal block 3200 can electrically connect two external wires to two internal wires. The external wires can carry power and signals to the luminaire. The internal wires, being inside the luminaire, can carry power and signals inside the luminaire. The panel feedthrough terminal block 3200 can be installed in a luminaire by fitting it into an opening such as opening 2001 of FIG. 20.

Figure 34:
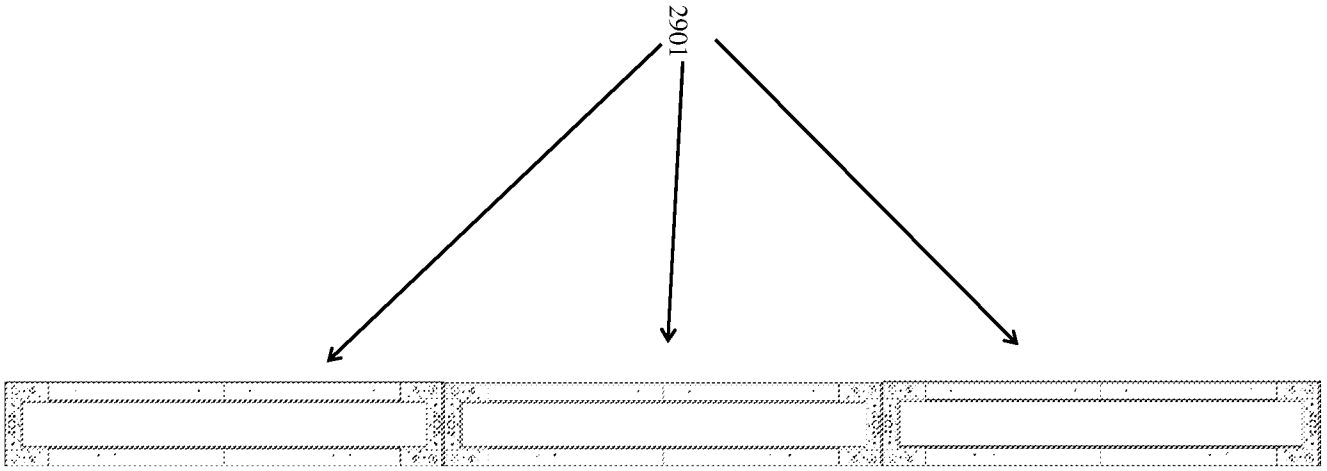
FIG. 34 illustrates three low profile luminaires in a continuous run configuration in accordance with aspects of the embodiments.

FIG. 34 illustrates three low profile luminaires 2901 in a continuous run configuration in accordance with aspects of the embodiments. Signal and power wires can run from one luminaire to the next by passing through continuous run holes 3101. As such, only one of the luminaires must be directly connected to a building's power and signal wires because the other two luminaires obtain power and signals through the continuous run holes.

Figure 35:
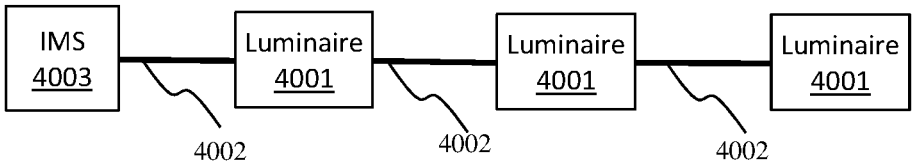
FIG. 35 illustrates an Illumination Management System (IMS) powering and controlling four luminaires in accordance with aspects of the embodiments.

FIG. 35 illustrates an Illumination Management System (IMS) 4003 powering and controlling four luminaires 4001 in accordance with aspects of the embodiments. An IMS 4003 can use IMS cables 4002 to provide power and control to the luminaires 4001. As shown in FIG. 25, the luminaires 4001 can be daisy chained with the IMS 4003 providing power and control signals to a first luminaire, the first luminaire passing the power and control signals to a second luminair, and so forth. An IMS can be connected to a building's mains power (e.g. 120 VAC or 240 VAC) and can produce conditioned DC power usable by the luminaires. IMS based lighting systems are advantageous because large AC-to-DC power blocks can be placed in the IMS such that the luminaires can be powered by small and inexpensive LED drivers that accept DC power and provide constant current power to the LEDs. The IMS can also control the luminaires by providing control signals.

Figure 36:
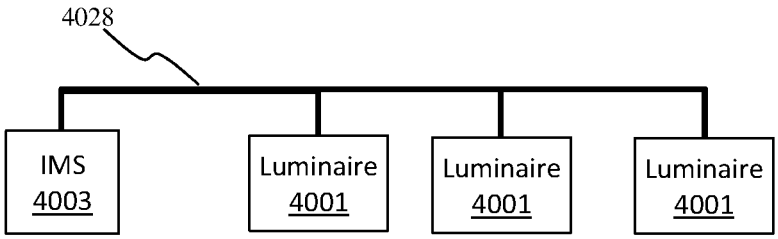
FIG. 36 illustrates an IMS powering and controlling four luminaires in accordance with aspects of the embodiments.

FIG. 36 illustrates an IMS 4003 powering and controlling four luminaires 4001 in accordance with aspects of the embodiments. Here, the IMS 4003 is connected to the luminaires by a multidrop IMS cable 4028 such that each of the luminaires 4001 receives power and control signals directly from the IMS 4003.

Figure 37:
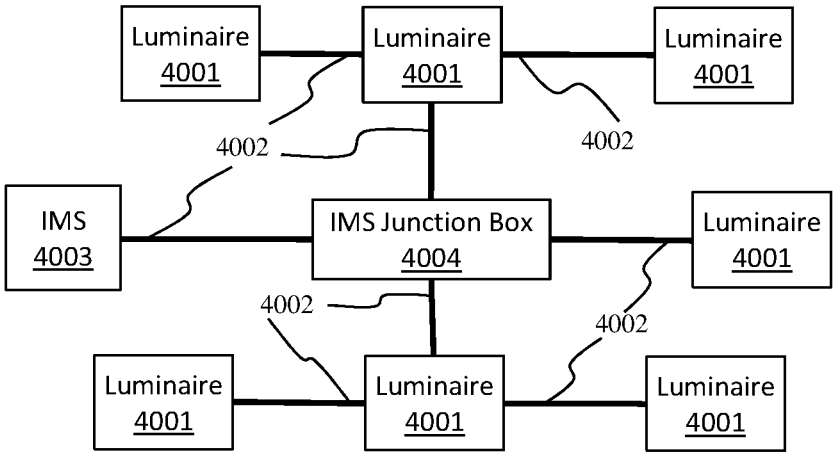
FIG. 37 illustrates an IMS powering and controlling seven luminaires in accordance with aspects of the embodiments.

FIG. 37 illustrates an IMS 4003 powering and controlling seven luminaires 4001 in accordance with aspects of the embodiments. The IMS 4003 is connected directly to an IMS junction box 4004 that distributes the power and control signals directly to three of the luminaires 4001. The remaining four luminaires 4001 receive the power and control signals directly from other luminaires. Alternatively, a multidrop IMS cable 4028 can be used instead of the combination of IMS cables 4002 and IMS junction box 4004.

Figure 38:
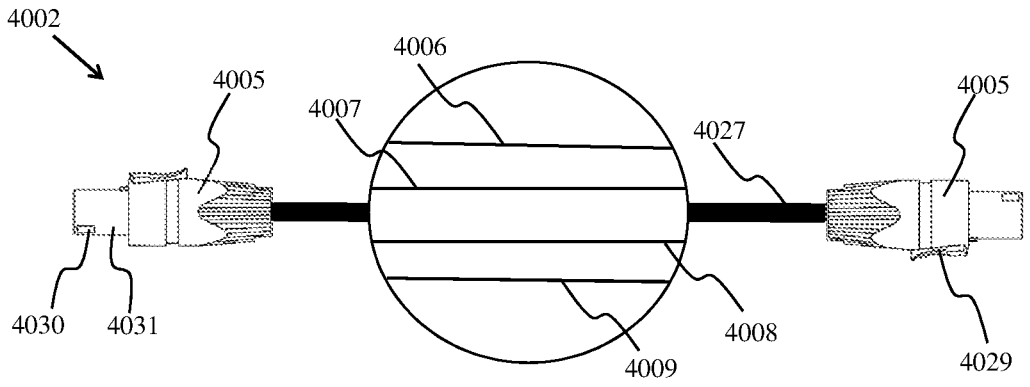
FIG. 38 illustrates an IMS cable in accordance with aspects of the embodiments.

FIG. 38 illustrates an IMS cable 4002 in accordance with aspects of the embodiments. IMS cable connectors 4005 are connected to either end of a four-conductor cable 4027. Two of the wires 4006, 4007 in the cable carry DC power with one wire 4006 being power (often labeled V+) and the other wire 4007 being the return line (often labeled V−). The other two wires 4008 and 4009 carry control signals. For example, the Digital Addressable Light Interface (DALI) is a well-known lighting standard that carries power and control signals over two wires with one called "+DALI bus" and the other called "−DALI bus". DALI, however, is limited to a maximum voltage of 22 VDC and a maximum current of 250 mA. The IMS system can therefor use DALI for control signaling on wires 4008 and 4009 while power is carried on wires 4006 and 4007. The IMS can provide 48 VDC at over 30 A which can be provided to the luminaires over wires 4006 and 4007. In practice, the IMS has operated with an output between 40 VDC and 52 VDC although 48 VDC plus/minus 1 VDC operation is preferred such that luminaires near the IMS do not receive too much voltage while luminaires far from the IMS, which can see less voltage due to transmission loss, receive enough voltage.

In this non-limiting example, the four conductors of cable 4027 are carrying V+, V−, +DALI, and −DALI. Wire 4006 carries V+. Wire 4007 carries V−. Wire 4008 carries +DALI. Wire 4009 carries −DALI.

Experimentation has shown that some connectors are advantageous when installing and operating a lighting system such as those of FIGS. 25-27 and especially for those installations having tens or hundreds of luminaires. Such systems are common in warehouses and data centers. The connectors should be installable by feel and should lock in place when properly installed. These properties are important because the connectors will often be manipulated by people on ladders and without a clear view (or with no view) of the operation they are trying to accomplish. For this reason, the IMS cable connector 4005 is shown as a Neutrik NL4FX cable connector which provides four electrical connections, a tactilely intuitive lock/release mechanism, and alignment keys. The Neutrik NL4FX pairs with chassis connectors 4010 such as the Neutrik NL4MD shown in FIGS. 29-36. The IMS cable connector 4005 can be installed in a IMS chassis connector 4010 by aligning its outer cylinder 4031 with the IMS chassis connector's cylindrical hole 4032, rotating until the key 4030 aligns with the IMS chassis connector's keyway 4034, and then pressing the IMS cable connector 4005 into the IMS chassis connector 4010 until the locking mechanism 4029 engages the IMS chassis connector's lock engagement 4033. These operations are easy to perform blind. Not shown is the IMS cable connector's center rod which fits in the IMS chassis connector's central hole 4035 when the IMS cable connector 4005 is installed in the IMS chassis connector 4010.

Figure 39:
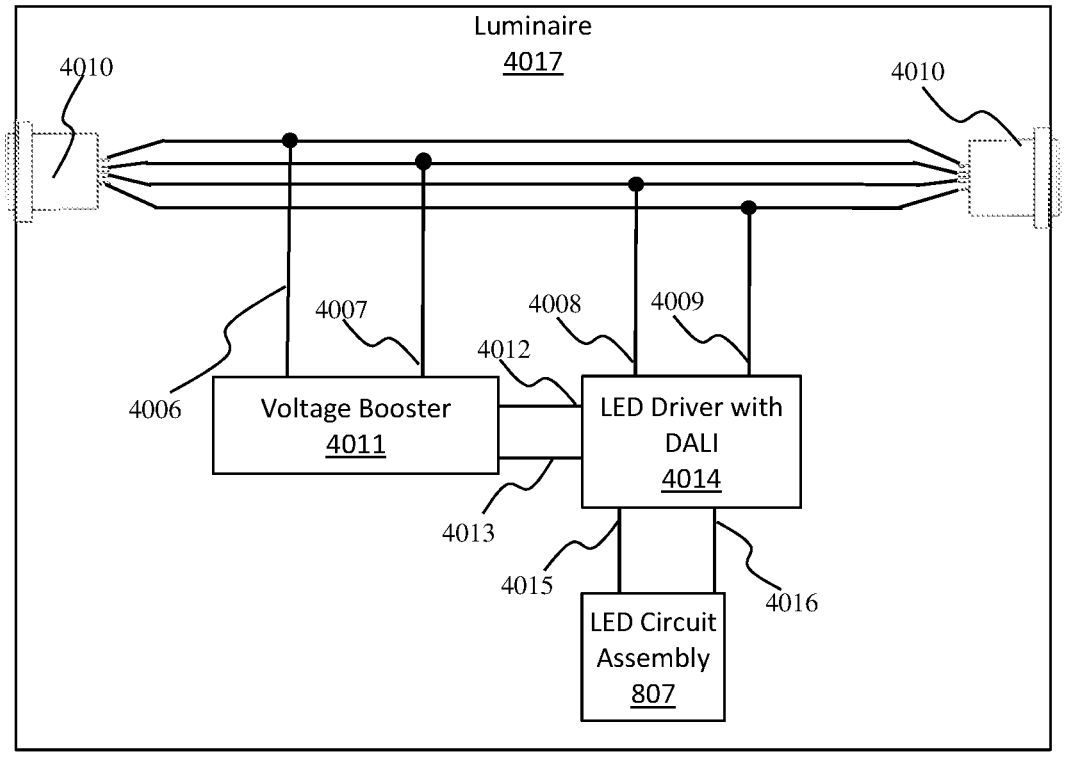
FIG. 39 illustrates a luminaire configured for power and control by an IMS in accordance with aspects of the embodiments.

FIG. 39 illustrates a luminaire 4017 configured for power and control by an IMS in accordance with aspects of the embodiments. The illustrated chassis connectors 4010 are the Neutrik NL4MD which mates with the NL4FX. V+ 4006 and V− 4007 are electrically connected to voltage booster 4011 which can provide a specified power on lines 4012, 4013 to the LED Driver 4014. +DALI 4008 and −DALI 4009 provide control signaling to the LED driver 4014. The LED driver 4014 powers the LED circuit assembly 807 via LED power lines 4015, 4016. Being DALI enabled, LED driver 4014 is addressable such it can be commanded to turn LED circuit assembly 807 on, off, or dimmed, etc. A single luminaire can have multiple LED drivers and LED circuit assemblies, each individually addressable and controllable via DALI. Although the DALI control signals can be provided by any device connected to the +DALI and −DALI lines, the IMS can house controllers that are accessible over the internet and that produce DALI signaling for the luminaires. This non-limiting example uses DALI instead of other two-wire control signaling protocols such as "0-10" (superseded by DALI).

The voltage booster 4011 accepts DC power at one voltage and outputs DC power at a higher voltage. Those practiced in the electronics arts are familiar with numerous appropriate circuits such as boost converters, DC-DC converters, etc.

The LED driver 4014 in certain prototype luminaires have been the Mean Well LDD-700H-WDA, LDD-1050H-DA, and similar devices with DALI interfaces that are addressable and controllable via +DALI 4008 and −DALI 4009.

Figure 40:
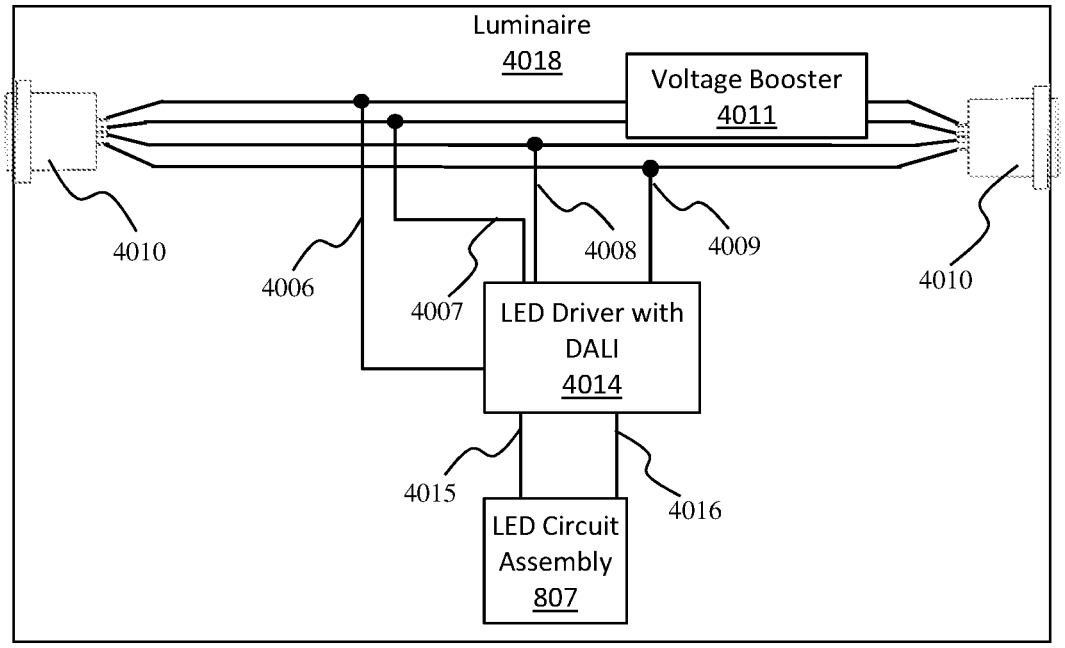
FIG. 40 illustrates a luminaire configured for power and control by an IMS in accordance with aspects of the embodiments.

FIG. 40 illustrates a luminaire 4018 configured for power and control by an IMS in accordance with aspects of the embodiments. Luminaire 4018 is similar to luminaire 4017 excepting that the voltage booster 4011 is configured to boost the voltage of the DC power passed from luminaire 4018 to another luminaire. Circuitry within or ancillary to the voltage booster can select a powered chassis connector 4010 as the power input and the other as the power output.

Figure 41:
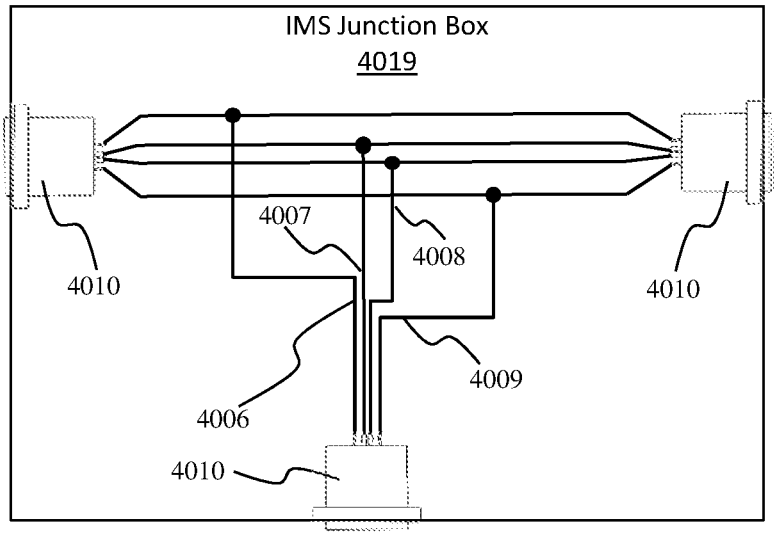
FIG. 41 illustrates an IMS junction box configured for power and control by an IMS in accordance with aspects of the embodiments.

FIG. 41 illustrates an IMS junction box 4019 configured use with an IMS 4003 in accordance with aspects of the embodiments. The junction box has three chassis connectors 4010. The IMS junction box 4019 directly electrically connects V+ on the chassis connectors using V+ wire 4006. The IMS junction box 4019 directly electrically connects V− on the chassis connectors using V− wire 4007. The IMS junction box 4019 directly electrically connects +DALI on the chassis connectors using +DALI wire 4008. The IMS junction box 4019 directly electrically connects −DALI on the chassis connectors using −DALI wire 4009. Other IMS junction boxes can have more than three chassis connectors that are similarly electrically connected.

Figure 42:
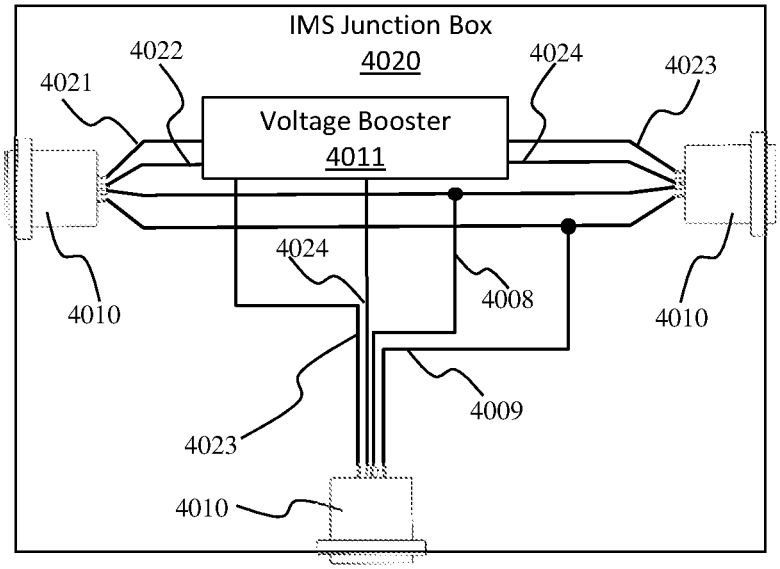
FIG. 42 illustrates an IMS junction box configured for power and control by an IMS in accordance with aspects of the embodiments.

FIG. 42 illustrates an IMS junction box 4020 configured for use with an IMS 4003 in accordance with aspects of the embodiments. The junction box has three chassis connectors 4010. The IMS junction box 4020 directly electrically connects +DALI on the chassis connectors using +DALI wire 4008. The IMS junction box 4020 directly electrically connects −DALI on the chassis connectors using −DALI wire 4009. As with luminaire 4018, IMS junction box 4020 boosts the voltage on the DC power lines. Here, DC power is received on wires 4021, 4022. DC power at a higher voltage is provided by the voltage booster on wires 4023 and 4024. Other IMS junction boxes can have more than three chassis connectors and additional voltage boosters that are similarly electrically connected.

Comparing the junction boxes 4019, 4020 and luminaires 4017, 4018 it can be seen that luminaires incorporate junction box functionality.

Figure 43:
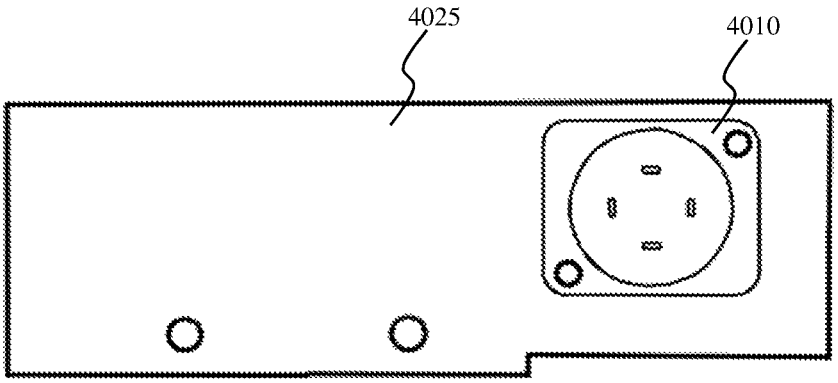
FIG. 43 illustrates a view of an access cover having an IMS chassis connector in accordance with aspects of the embodiments.
Figure 44:
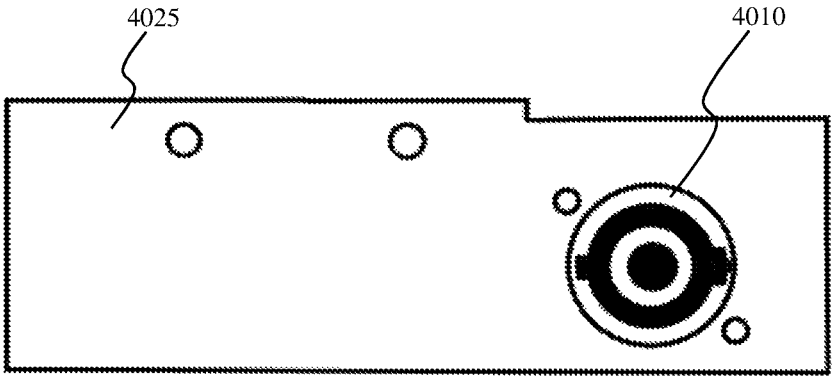
FIG. 44 illustrates another view of an access cover having an IMS chassis connector in accordance with aspects of the embodiments.

FIGS. 43 and 44 illustrate an access cover 4025 luminaire 4001 having an IMS chassis connector 4010 in accordance with aspects of the embodiments. FIG. 43 shows the underside of the access cover which would be hidden from view when the access cover is installed. FIG. 34 shows the top side of the access cover which is not hidden from view when the access cover is installed.

Figure 45:
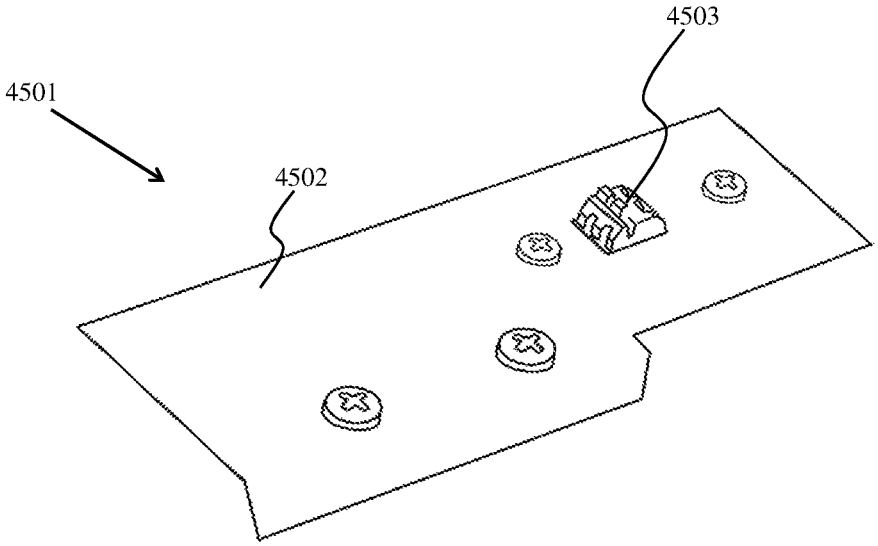
FIG. 45 illustrates an access cover and a terminal block in accordance with aspects of the embodiments.
Figure 46:
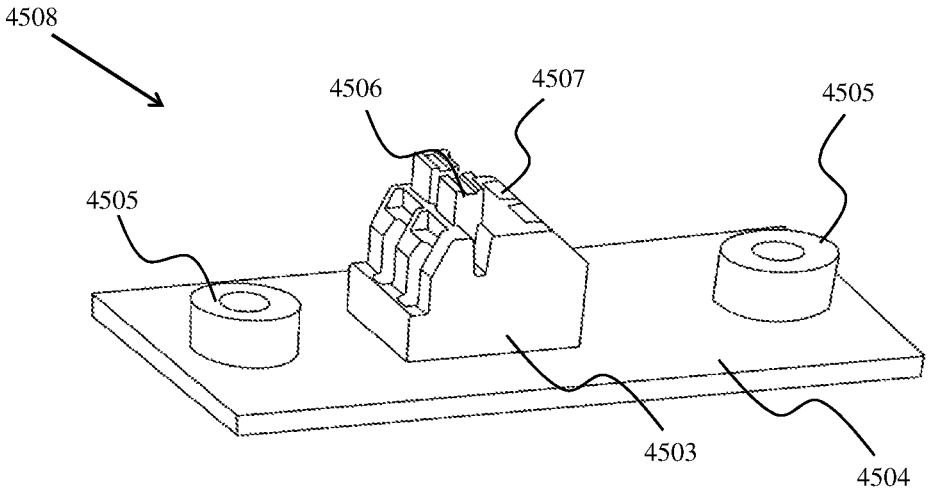
FIG. 46 illustrates a terminal block assembly in accordance with aspects of the embodiments.

FIG. 45 illustrates an access cover assembly 4501 having a terminal block assembly 4508 in accordance with aspects of the embodiments. The terminal block assembly 4508, shown in greater detail in FIG. 46, is illustrated as attached to the access cover 4502 using two screws threaded into two standoffs 4505. A terminal block 4503 can be seen positioned within and accessible through a hole in the access cover 4502. The terminal block assembly 4508 has a printed circuit board 4504. The standoffs 4505 and a terminal block 4503 are attached to the printed circuit board 4503. The illustrated terminal block is a Phoenix Contact SPTAF1 which has a push-in spring type connection method where button 4506 can be pressed as a wire is inserted into an opening 4507. The terminal block 4503 clamps onto the wire when the button 4506 is released. Wiring or contacts on the back side of the circuit board can pass electric power to the luminaire's internal components. The illustrated terminal block provides two connection points for external wiring. As such, the luminaire can be configured to receive DC electric power or AC electric power.

It will be appreciated that variations of the above-disclosed and other features and functions, or alternatives thereof, may be desirably combined into many other different systems or applications. It will also be appreciated that various presently unforeseen or unanticipated alternatives, modifications, variations or improvements therein may be subsequently made by those skilled in the art which are also intended to be encompassed by the following claims.

What is claimed is:

1. A luminaire comprising:

a housing comprising a plurality of housing members, wherein the housing members comprise a housing top, a housing bottom, a housing first end, and a housing second end, wherein the housing members all have a housing extrusion profile that is the same for all the housing members, wherein the housing top and the housing bottom are equally long, wherein the housing first end and the housing second end are equally long, wherein the housing members are permanently and rigidly joined to form the housing, wherein the housing is rectangular, wherein the housing members have an LED backing, a lens shelf, a top slot, a screw groove, and a cover engagement;

a plurality of housing screws wherein the housing screws passes through a plurality of housing screw holes and are threaded into the screw groove of at least one of the housing members;

a top LED circuit assembly and a bottom LED circuit assembly, wherein the top LED circuit assembly is disposed along the LED backing of the housing top, wherein the bottom LED circuit assembly is disposed along the LED backing of the housing bottom, and wherein the top LED circuit assembly and the bottom LED circuit assembly each comprise a plurality of LEDs;

a lens disposed on a housing lens shelf, wherein the housing lens shelf comprises the lens shelf of each of the housing members, and wherein the plurality of LEDs are configured to emit light into the lens;

a plurality of side covers having a side cover extrusion profile that is the same for all the side covers, wherein each of the side covers comprise a top engagement, a bottom engagement, and a lens interface, wherein the top engagement of each of the side covers is positioned within the top slot of either the housing top or the housing bottom, wherein the bottom engagement of each of the side covers is positioned under the cover engagement of either the housing top or the housing bottom, and wherein the lens interface prevents the lens from exiting the housing; and four access covers having an access cover profile that is the same for all the four access covers and is different from the side cover extrusion profile, wherein each of the four access covers comprises a slot engagement and at least one of the plurality of housing screw holes, wherein the slot engagement of each of the four access covers is positioned in part within the top slot of either the housing top or the housing bottom, wherein the slot engagement of each of the four access covers is positioned in part within the top slot of either the housing first end or the housing second end, and wherein each of the four access covers is attached to the housing by at least one of the plurality of housing screws.

2. The luminaire of claim 1 wherein each of the four access covers are permanently attached to at least one of the plurality of side covers.

3. The luminaire of claim 1 herein two of the plurality of side covers comprises at least one of the plurality of housing screw holes and wherein each of the plurality of side covers is attached to the housing by at least one of the plurality of housing screws.

4. The luminaire of claim 1 further comprising two end covers having an end cover extrusion profile that is the same for both of the two end covers, wherein each of the two end covers comprise a top end engagement, a bottom end engagement, a lens end interface, and at least one of the plurality of housing screw holes, wherein each of the two end covers is attached to the housing by at least one of the plurality of housing screws, wherein the top end engagement of each of the two end covers is positioned within the top slot of either the housing first end or the housing second end, wherein the bottom engagement of each of the side covers is positioned under the cover engagement of either the housing first end or the housing second end, and wherein the lens end interface prevents the lens from exiting the housing.

5. The luminaire of claim 4 wherein the end cover extrusion profile is the same as the side cover extrusion profile.

6. The luminaire of claim 1 wherein at least one of the four access covers comprises an access opening that provides access to an electric socket inside the luminaire, wherein the electric socket is configured to engage a plug to thereby pass electric power through the electric socket and into the luminaire.

7. The luminaire of claim 1 wherein at least one of the four access covers comprises a knockout that provides access to the interior of the luminaire when the knockout is knocked out.

8. A luminaire comprising:

a front, a back, a top, a bottom, a first end, a second end, a length, a height, and a thickness, wherein the first end and the second end are separated by the length, wherein the top and the bottom are separated by the height, and wherein the front and the back are separated by the thickness;

a housing comprising a plurality of housing members, wherein the housing members comprise a housing top, a housing bottom, a housing first end, and a housing second end, wherein the housing members all have a housing extrusion profile that is the same for all the housing members, wherein the housing top and the housing bottom are equally long, wherein the housing first end and the housing second end are equally long, wherein the housing members are permanently and rigidly joined to form the housing, wherein the housing is rectangular, wherein the housing members have an LED backing, a lens shelf, a top slot, a screw groove, and a cover engagement;

a plurality of housing screws wherein the housing screws passes through a plurality of housing screw holes and are threaded into the screw groove of at least one of the housing members;

a top LED circuit assembly and a bottom LED circuit assembly, wherein the top LED circuit assembly is disposed along the LED backing of the housing top, wherein the bottom LED circuit assembly is disposed along the LED backing of the housing bottom, and wherein the top LED circuit assembly and the bottom LED circuit assembly each comprise a plurality of LEDs;

a lens comprising a reflective layer, wherein the lens is disposed on a housing lens shelf, wherein the housing lens shelf comprises the lens shelf of each of the housing members, wherein the plurality of LEDs are configured to emit light into the lens, and wherein the reflective layer is configured to direct a portion of the light from the plurality of LEDs out the front and another portion of the light from the plurality of LEDs out the back; and a plurality of side covers having a side cover extrusion profile that is the same for all the side covers, wherein each of the side covers comprise a top engagement, a bottom engagement, a lens interface, and at least one of the housing screw holes, wherein the top engagement of each of the side covers is positioned within the top slot of either the housing top or the housing bottom, wherein the bottom engagement of each of the side covers is positioned under the cover engagement of either the housing top or the housing bottom, wherein each of the side covers is attached to the housing by at least one of the housing screws, and wherein the lens interface prevents the lens from exiting the housing.

9. The luminaire of claim 8 further comprising a diffusing lens completely covering one side of the lens and preventing the lens from directly contacting the lens interface of the side covers and wherein the diffusing lens diffuses the light exiting the back.

10. The luminaire of claim 8 further comprising a lens cover completely covering one side of the lens and preventing the lens from directly contacting the lens interface of the side covers and wherein the lens cover blocks the light from exiting the back.

11. The luminaire of claim 8 further comprising a motion sensor, and a sensor lens covering a sensor opening in the housing wherein the motion sensor is configured to detect motion and to cause the plurality of LEDs to emit the light.

12. The luminaire of claim 8 further comprising a power conditioner configured to receive electric power from outside the luminaire and to provide conditioned electric power to the plurality of LEDs.

13. The luminaire of claim 8 wherein the housing comprises a closed channel formed by joining the plurality of housing members.

14. The luminaire of claim 8 wherein the lens comprises a clear acrylic sheet.

15. The luminaire of claim 8 wherein the thickness is less than 1.4 inches.

16. The luminaire of claim 8 wherein the height is greater than 5.8 times the thickness and less than 6 times the thickness.

17. The luminaire of claim 8 further comprising an IMS chassis connector attached to an access cover wherein electric power passes through the IMS chassis connector via two conductors and wherein control signals pass through the IMS chassis connector via two different conductors.

18. A luminaire comprising:

a housing top that has a housing extrusion profile that is configured to form an LED backing, a lens shelf, a top slot, a screw groove, and a cover engagement;

a housing bottom that has the housing extrusion profile;

a housing first end that has the housing extrusion profile and that is permanently and rigidly joined to the housing top and the housing bottom;

a housing second end that has the housing extrusion profile and that is permanently and rigidly joined to the housing top and the housing bottom;

a housing that includes the housing top, the housing bottom, the housing first end, and the housing second end;

a lens disposed on a housing lens shelf formed from the lens shelf of the housing top, the lens shelf of the housing bottom, the lens shelf of the housing first end, and the lens shelf of the housing second end;

a top LED circuit assembly disposed along the LED backing of the housing top and configured to emit light into the lens;

a bottom LED circuit assembly disposed along the LED backing of the housing bottom and configured to emit light into the lens;

a plurality of side covers that each have a side cover extrusion profile that is configured to form a top engagement, a bottom engagement, and a lens interface; and an IMS chassis connector configured to pass electric power to the luminair via two conductors, and configured to pass control signals to the luminair via two different conductors, wherein the top engagement of each of the side covers is positioned within the top slot of either the housing top or the housing bottom, the bottom engagement of each of the side covers is positioned under the cover engagement of either the housing top or the housing bottom, and the lens interface prevents the lens from exiting the housing.

* * * * *